US008061417B2

(12) United States Patent
Gray

(10) Patent No.: US 8,061,417 B2
(45) Date of Patent: Nov. 22, 2011

(54) PRIORITY CONDITIONING IN A MULTI-ZONE CLIMATE CONTROL SYSTEM

(75) Inventor: Josh Thomas Gray, Portland, OR (US)

(73) Assignee: Home Comfort Zones, Inc., Beaverton, OR (US)

( * ) Notice: Subject to any disclaimer, the term of this patent is extended or adjusted under 35 U.S.C. 154(b) by 1147 days.

(21) Appl. No.: 11/829,865

(22) Filed: Jul. 27, 2007

(65) Prior Publication Data

US 2009/0030555 A1 Jan. 29, 2009

(51) Int. Cl.

| | |
|---|---|
| ***F24F 3/14*** | (2006.01) |
| ***F24F 6/00*** | (2006.01) |
| ***F24F 11/053*** | (2006.01) |
| ***G05D 23/185*** | (2006.01) |
| ***G05D 23/12*** | (2006.01) |
| ***G05D 23/275*** | (2006.01) |
| ***G05D 22/02*** | (2006.01) |
| ***G05B 21/00*** | (2006.01) |
| ***G05B 13/00*** | (2006.01) |
| ***G05B 15/00*** | (2006.01) |
| ***G01M 1/38*** | (2006.01) |
| ***F24D 19/10*** | (2006.01) |

(52) U.S. Cl. ..... 165/208; 165/212; 165/222; 165/289; 700/277; 236/1 B; 236/1 C; 236/44 C

(58) Field of Classification Search ..... 700/275–277; 165/200, 201, 205, 207, 208, 211, 212, 222, 165/237, 238, 253, 287–289; 236/1 B, 1 C, 236/44 R, 44 C See application file for complete search history.

(56) References Cited

U.S. PATENT DOCUMENTS

| | | | | |
|---|---|---|---|---|
| 4,407,447 | A * | 10/1983 | Sayegh | 236/49.3 |
| 4,487,028 | A * | 12/1984 | Foye | 62/115 |
| 5,303,767 | A * | 4/1994 | Riley | 165/208 |
| 5,779,143 | A * | 7/1998 | Michaud et al. | 237/8 R |
| 6,957,696 | B1 * | 10/2005 | Krumnow | 165/208 |
| 7,455,237 | B2 * | 11/2008 | Kates | 236/1 B |
| 7,716,943 | B2 * | 5/2010 | Seefeldt | 62/324.6 |
| 2007/0082311 | A1 * | 4/2007 | Yamaguchi et al. | 432/1 |
| 2009/0221224 | A1 * | 9/2009 | Centofante | 454/76 |

* cited by examiner

*Primary Examiner* — Crystal J Barnes-Bullock
(74) *Attorney, Agent, or Firm* — Blakely Sokoloff Taylor & Zafman, LLP.

(57) ABSTRACT

A method and mechanism for performing a prioritized determining of a climate conditioning to be provided to a zone in a multiple zone structure. In one embodiment of the invention, the determining of a climate conditioning to be provided to a zone is to be a prioritized determining, where a climate control condition is determined to satisfy a priority condition of the first zone. In another embodiment, the first priority condition associated with the first zone is based at least in part on an assigning of a first priority to the first zone.

23 Claims, 7 Drawing Sheets

Priority Set 700

| Priority Type 702 | Climate Conditioning Resources 704 | Priority Levels 706 |
|---|---|---|
| 1 | A: Dehumidifier | 1, 2 |
| 2 | B: Furnace | 1-10 |
| 3 | C: Refrigerator | 1-3 |
| 4 | D, E & F: $O_2$, Inert gas, Air filter | 1-6 |
| 5 | B: Furnace | 1-8 |

FIG. 7A

Priority Conditions 710

| Priority Type 702 | Priority Condition Information 714 |
|---|---|
| 1 | Total humidifier load > 50% |
| 2 | $T_N < 45°$ F |
| 3 | ($T_N > T_{ref} + 5°$ F) AND ($H_N > 80\%$) |
| 4 | $O_2 < 18\%$ |
| 5 | $45° \leq T_N \leq 55°$ F |

FIG. 7B

Zone 1 720

| Priority Type 702 | Priority Level 724 | Reference Condition 726 |
|---|---|---|
| 2 | 2 | N/A |
| 3 | 1 | $T_{ref} = T_{des}$ (75° F) |
| 5 | 4 | N/A |

FIG. 7C

Priority Type 3 800

| Priority Level 802 | Response Information 804 |
|---|---|
| 1 | Refrigeration +10% (same Δ% from all other zones) |
| 2 | Refrigeration +20% (same Δ% from all other zones) |
| 3 | Refrigeration +30% (same Δ% from all other zones) |

FIG. 8A

Response Information 820

Priority Type: B Priority Level: 4

Priority Type: A Priority Level: 1

Priority Type: A Priority Level: 1

Contributing Zone Identifier Information 832

| Zones | Normal Condition | Priority Condition |
|---|---|---|
| Zone Group "Bedrooms" and Zone 2 | N | Y |

Distribution Information 834

| Response Parameter | Value |
|---|---|
| Weight | 20% |
| Increments | 50 CFM |
| Minimum Reserve | 250 CFM |

850

840

830

FIG. 8B

PRIORITY CONDITIONING IN A MULTI-ZONE CLIMATE CONTROL SYSTEM

BACKGROUND OF THE INVENTION

1. Field of the Invention

The invention relates generally to the controlling of climate conditions in multiple zones of a building. In one embodiment of the invention, a climate conditioning to be provided to a first zone in the multiple zones of the building is determined based at least in part on a priority which is assigned to the first zone.

2. Background Art

Existing climate control systems provide various combinations of climate conditioning both to commercial and to residential structures. For example, some existing climate control systems keep different rooms at or near respective pre-set desired temperatures by providing the rooms with respective levels of air conditioning. Similarly, different rates of heated air delivered from a forced air furnace may be provided to different rooms based on their respective pre-set desired temperatures. Some of these existing climate control systems also allow users to group a number of pre-set desired temperatures into one or more modes to automate the adjusting of climate preferences for various rooms at one time. For example, when returning from a vacation back to regular occupancy of a home, a user can deactivate an energy saving mode in favor of a normal occupancy mode, thereby changing numerous desired temperature settings at one time from one location.

In designing climate control systems and equipment, technicians typically take into account such factors as the size of the structure being conditioned, the building materials and insulation standards used, its orientation relative to the sun & prevailing winds, the local climate, etc. In the past, prevailing wisdom in the construction community tended to over-size conditioning equipment—closer to the peek average load on the structure than the nominal load—to reduce the possibility that the thermodynamic load can ever get ahead of the equipment so that a comfortable environment cannot be maintained. However, over-sized climate control systems tend to be more expensive to install and run, they tend to work at operating points which are less efficient and/or more damaging to component parts, and they tend to provide a loud or otherwise noticeable 'blast' of conditioning when turning on.

Under more ideal design practice, equipment is usually sized relative to a "nominal load", whereby a level of output being made available when the conditioning equipment is running should reasonably approximate the average conditioning energy needed by the structure over the entire seasonal year. Since conditioning equipment typically provides very few discrete levels of conditioning capacity, control may be provided by time-cycling, wherein equipment is turned on for a period of time, and then turned off for a period of time. The reduced average energy delivered over time approximates the average load needed in the house.

At any given time, various climate conditioning requirements of individual rooms of a building determine an aggregate climate conditioning load carried by a climate control system. This aggregate load can change significantly over time as environmental conditions, space utilization and occupancy and target conditioning objectives change. Consequently, while a climate control system of a structure should ideally rely on more reasonably-sized equipment designed for nominal loads, it often does not. When the energy load on the structure is above average, reasonably-sized equipment may not be able to keep up with the energy requirements of the conditioned space. The equipment will run continuously or nearly continuously and may not be able to sustain the desired environmental conditions of the building at all times. This often results in increased wear and tear on parts, higher energy bills, and/or an inability to bring or maintain rooms within their desired temperature ranges.

BRIEF DESCRIPTION OF THE DRAWINGS

The various embodiments of the present invention are illustrated by way of example, and not by way of limitation, in the figures of the accompanying drawings and in which:

FIG. 7A is a table representing a set of priorities used for a prioritized determining of a climate conditioning according to one embodiment of the invention.

FIG. 7B is a table representing priority conditions associated with a set of priorities used for a prioritized determining of a climate conditioning according to one embodiment of the invention.

FIG. 7C is a table illustrating an association of a set of priorities to a zone for prioritized determining of a climate conditioning according to one embodiment of the invention.

FIG. 8A is a table illustrating response information for priority levels of a priority type, used to determine a climate conditioning according to an embodiment of the invention.

FIG. 8B is a block diagram illustrating response information for various priority types and priority levels according to one embodiment of the invention.

DETAILED DESCRIPTION

Figure 1:
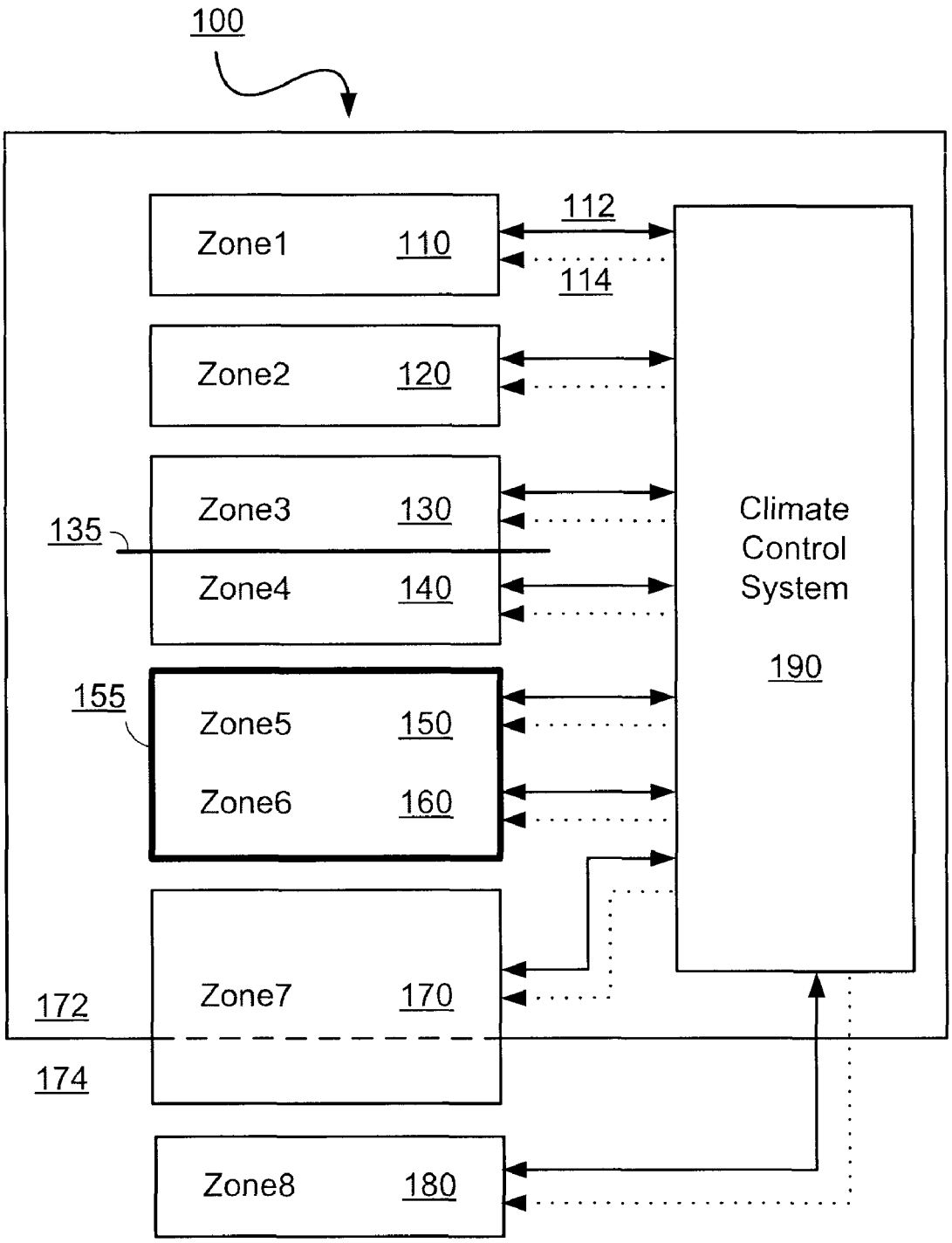
FIG. 1 is a block diagram illustrating a structure configured to practice climate control according to an embodiment of the invention.

FIG. 1 is a block diagram illustrating a structure 100 configured to practice climate control according to an embodiment of the invention. Structure 100 may be any structure adaptable to provide individual climate conditioning to multiple zones of the structure. The structure may include a fixed structure—e.g. any of a variety of commercial, residential and/or industrial buildings including a house, apartment, office, and warehouse—and/or a movable structure such as a ship, airplane, train or container, for example.

As used herein, a zone of structure 100 is understood to mean a designated area or volume which is on, in and/or near structure 100, the designation for the benefit of implementing climate control of a particular granularity. A zone which is outside a structure is understood to be "zone of the structure" insofar as a climate control system of the structure may deliver climate conditioning to zone.

Although embodiments of the invention may implement climate control for any of a variety of multiple zones, eight zones 110, 120, 130, 140, 160, 170 and 180 are shown in structure 100 to illustrate various possible zone configurations. By way of illustration, a zone may be located entirely within interior 172 of structure 100, partially within interior 172 and partially exterior 174 to structure 100, or entirely exterior 174 to structure 100, as illustrated by Zone1 110, Zone7 170 and Zone8 180, respectively. Furthermore, two zones may be completely separated from one another by at least part of the interior volume 172 of structure 100, as with Zone1 110 and Zone2 120. Alternatively or in addition, two zones may be separated from one another by a single structural element such as a wall 135, as with Zone3 130 and Zone4 140. Alternatively or in addition, two given zones may be contained within a single interior structure of structure 100 such as a room 155, as with Zone5 150 and Zone6 160.

It will be understood by one of ordinary skill in the climate control arts that a given zone may be part of a group of zones which may be itself treated as a zone for the purposes of determining an overall climate conditioning to provide to the group of zones as a whole. Conversely, while a given climate conditioning may be determined for a particular zone according to a given embodiment of the invention, additional methods and mechanisms may further determine a subset of the determined climate conditioning to be provided to "sub-zones" (not shown) of the particular zone. For the purposes of describing the invention, the discussion is limited herein to the determining of climate conditioning to be provided to zones. It will be appreciated to one of ordinary skill in the art that embodiments of the invention may be extended to pertain to a group of zones which are to be treated as a zone, and/or to sub-zones within a particular zone.

A zone in structure 100 may receive climate conditioning from a climate control system 190. Climate conditioning may be provided to facilitate the controlling of a climate of a given zone. As used herein, climate conditioning refers to the providing of one or more climate conditioning resources to control at least partially one or more aspects of the climate of the given zone. The climate of a zone may include any of a variety of combinations of aspects of a climate which include, but are not limited to, temperature, humidity, atmospheric content, precipitation, atmospheric pressure and particulate count. The climate conditioning resources may include any of a variety of resources including, but not limited to, heating, cooling, refrigerating, humidifying, dehumidifying, gas admixing (e.g. oxygenating, inerting), ventilating, recirculating, pressurizing, depressurizing, filtering, etc.

An embodiment of the invention illustrated in FIG. 1 is now described in detail with respect to the providing of a climate conditioning 114 from climate control system 190 to Zone1 110. It is understood that ideas described hereafter may be extended to alternatively or additionally apply to the determining of a climate conditioning to provide to various other zones such as zones 120, 130, 140, 150, 160, 170 and 180. In the illustrative case of Zone1 110, climate control system 190 may provide climate conditioning 114 to Zone1 110. Climate control system 190 may be directly or indirectly in communication 112 with Zone1 110 and/or one or more of the zones 110, 120, 130, 140, 150, 160, 170 and 180 for the exchange of information related to the providing of climate conditioning to one or more of the zones 110, 120, 130, 140, 150, 160, 170 and 180. The various communication paths between climate control system 190 and the respective zones 110, 120, 130, 140, 150, 160, 170 and 180 are indicated by solid lines, while the various climate conditionings provided from climate control system 190 to the respective zones 110, 120, 130, 140, 150, 160, 170 and 180 are indicated by dotted lines.

It is understood that FIG. 1 depicts a functional relationship of the climate control system 190 to the zones 110, 120, 130, 140, 150, 160, 170 and 180. More particularly, climate conditioning 114 may be functionally provided from climate control system 190 to Zone1 110, although the physical implementation of climate conditioning 114 may include one or more climate aspects being variously conducted to, from or neither to nor from Zone1 110. For example, climate conditioning 114 may include heat being ventilated away from Zone1 110, humidity being carried to Zone1 110, and/or a current being conducted through an immobile heating element positioned in Zone1 110. A climate conditioning 114 may include providing climate control resources for different climate aspects simultaneously. Alternatively or in addition climate conditioning 114 may include aspects of the climate remaining static insofar as they are not aspects of the climate of Zone1 110 which are included in the climate conditioning 114. Furthermore, climate conditioning 114 may include variously operating and/or moving climate control mechanisms of climate control system 190 directly and/or indirectly to control the climate of Zone1 110. For example, providing a ventilation to Zone1 110 may include a selective opening and/or closing of one or more vents of zones 120, 130, 140, 150, 160, 170 and 180.

Figure 2:
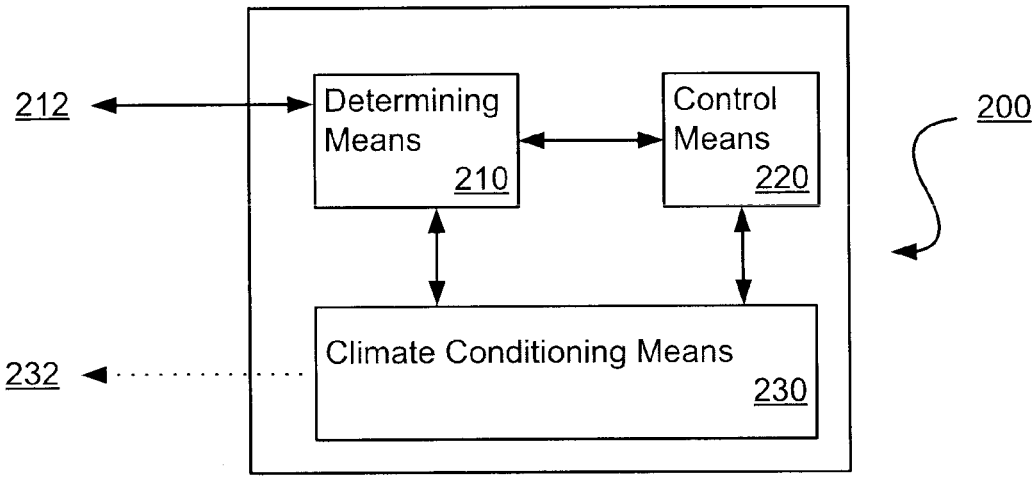
FIG. 2 is a block diagram illustrating a climate control system to perform a prioritized determination of a climate conditioning according to embodiments of the invention.

FIG. 2 is a block diagram illustrating a climate control system 200 capable of providing climate conditioning to multiple zones according to embodiments of the invention. Climate control system 200 may, for example, be the climate control system 190 in structure 100. In order to provide a particular climate conditioning, climate control system 200 may need to determine the climate conditioning to be provided. Climate control system 200 may include a determining means 210 for making said determination. In embodiments of the invention, determining means 210 may receive information in a signal 212 indicating at least in part a climate control condition associated with the climate control system. As used herein, a climate control condition refers to a state of a climate control system, e.g. climate control system 200. A climate control condition may include, for example, an indication a zone climate controlled by the climate control system—e.g. a state of one or more climate aspects of the zone. Climate conditions may include one or more aspects of a climate which are measured at a distinct time and/or one or more aspects of a climate which are measured over respective periods of time. Alternatively or in addition, a climate control condition may include user settings related to the zone, such as a priority assigned to a particular zone. Alternatively or in addition, a climate control condition may include an indication of a state of operation of the climate control system.

Determining means 210 may determine a climate conditioning to be provided to a zone based at least in part on the information in signal 212. Determining a climate conditioning to provide to a zone may include determining a level of climate conditioning and/or determining a change in a level of climate conditioning. Alternatively or in addition, determining a climate conditioning to provide to a zone may include determining a change to make to one or more climate conditioning means. Alternatively or in addition, determining a climate conditioning to provide to a zone may include determining a change to make to one or more climate conditioning means.

Determining means, discussed below, may include, for example, one or more of a variety of electrical and/or mechanical means for determining a climate conditioning, including but not limited to electrical hardware and/or software. The information in signal 212 may, for example, be provided to determining means 210 from a zone controlled by climate control system 200. Although signal 212 is shown as being provided from outside of climate control system 200, in various embodiments the signal 212 may be at least partially provided to determining means 210 from another component within climate control system 200 itself.

Climate control system 200 may further include a control means 220 coupled to determining means 210 to direct the providing of a climate conditioning. Control means may include, for example, one or more of a variety of electrical and/or mechanical means for generating control signals, including but not limited to a driver, a controller, or any similar mechanism, e.g. as implemented in hardware and/or software. In one embodiment, upon determining a climate conditioning based on information in signal 212, determining means 210 may communicate an indication of the determined climate conditioning to control means 220, which may create one or more control signals to direct the providing of the determined climate conditioning. Climate control system 200 may further include a climate conditioning means 230 coupled to control means 220 to provide a climate conditioning 232 in response to direction from control means 220. Climate conditioning means 230 represents one or more means for generating, conveying, distributing and/or otherwise providing one or more climate conditioning resources to a zone. For example, climate conditioning means 230 may include, but is not limited to, one or more vents, ducts, valves, motors, fans, plumbing, refrigerants, heat conductors, refrigerators, air conditioners, furnaces, compressed gases, filters, etc. Climate conditioning means 230 may further include any of a variety of solenoids, actuators or similar devices configured to change or enable the operation and/or configuration of one or more other means in climate conditioning means 230, e.g. responsive to control signals of control means 220

Figure 3:
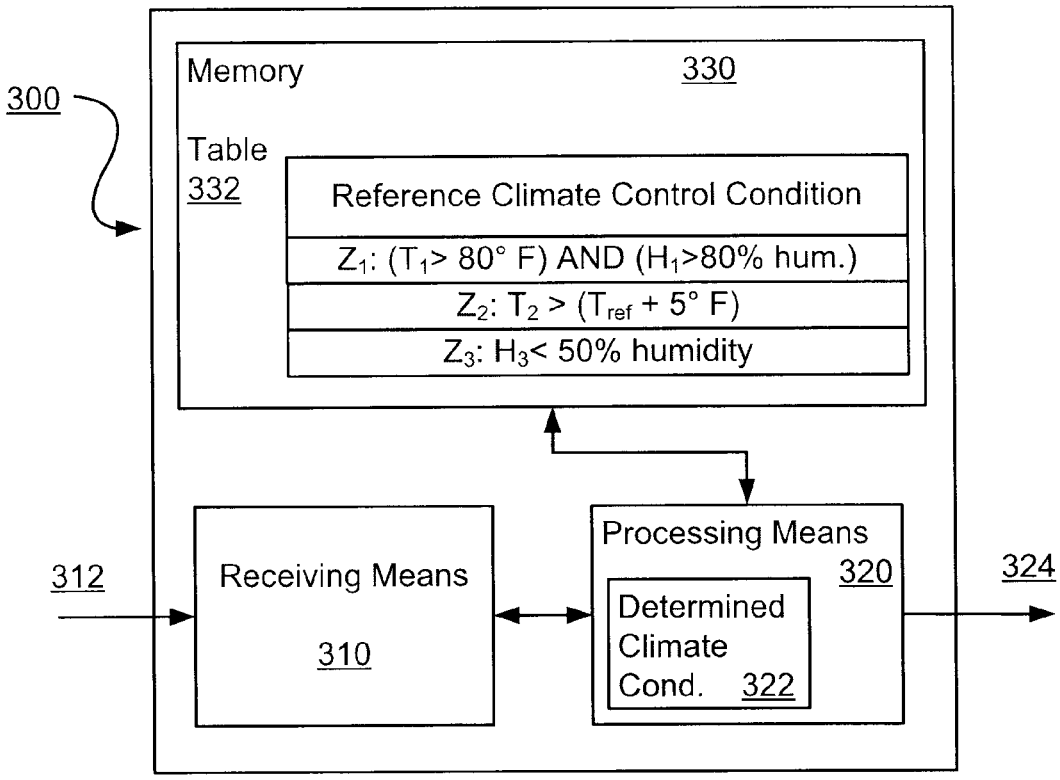
FIG. 3 is a block diagram illustrating a determining means capable of determining, according to embodiments of the invention, a climate conditioning to be provided to a zone.

FIG. 3 is a block diagram illustrating determining means 300 capable of determining, according to embodiments of the invention, a climate conditioning to be provided to a zone. In various embodiments of the invention, determining means 300 may be the determining means 210 of FIG. 2. Determining means 300 may include a receiving means 310 to receive information in a signal 312 indicating at least in part a climate control condition. In embodiments of the invention, signal 312 may include an indication of a climate condition of a zone to be provided a climate conditioning. Alternatively or in addition, signal 312 may include an indication of a priority of the zone to be provided a climate conditioning. Alternatively or in addition, signal 312 may include an indication of one or more other zones and or information related to a level or type of load being carried by at least part of a climate control system.

Receiving means 310 may include any of a variety of means for providing at least part of the information in signal 312 to processing means 320 in a way which aids processing means 320 in determining a climate conditioning to be provided to a zone. Receiving means may include means for coordinating the receiving of information in the signal 312, as through a handshaking protocol, for example. Alternatively or in addition, receiving means 310 may include any of a variety of means for tranducing or otherwise converting one or more different combinations of electrical, mechanical, chemical, thermal and/or other similar signals into a signal suitable for the determining of a climate condition. In various embodiments of the invention, receiving means 310 may include, for example, one or more of an analog-to-digital converter, a digital-to-digital converter, a code converter and a transducer.

Determining means 300 may further include a processing means 320 coupled to receiving means 310 in order to be provided with at least part of the information in signal 312, in aid of processing means 320 determining a climate conditioning to be provided to a zone. Processing means 320 may include any of a variety of combinations of one or more physical processors and one or more logical processors for performing data processing. Determining means 300 may further include a memory 330 coupled to processing means 320 to store climate control condition information in aid of determining a climate conditioning to be provided to a zone. In embodiments of the invention, memory 330 may include a table 332 or similar data structure to store one or more reference climate control conditions. A determination of a climate conditioning to be provided to a zone may be based at least in part on whether a particular reference climate control condition is satisfied. For example, in embodiments of the invention, processing means 320 may detect the existence of a climate control condition based on the information from signal 312 provided by receiving means 310. If the existing climate condition fails to satisfy any of the reference climate control conditions, for example, determining means 320 may determine a climate conditioning 322 based on a first determining method. If the existing climate condition satisfies some combination of one or more reference climate control conditions, determining means may determine the climate conditioning 322 based on a second determining method.

In one embodiment of the invention, a reference climate control condition may be related to the climate conditions of one or more zones. By way of illustration, a table 332 stored in memory 330 lists three zones, each associated with a respective reference climate control condition. The climate control condition may be expressed with reference to more than one aspect of a climate. In the illustrative case of table 332, one reference climate control condition may be satisfied when zone $Z_1$ is both above 80° F. in temperature and 80% relative humidity. Additionally or in the alternative, the climate control condition may be expressed relative to one or more reference values, where each respective reference value may be a fixed value or one takes different values at different time. For example, a second reference climate control condition may be satisfied when zone $Z_2$ is has a temperature above 5° F. over some reference temperature $T_{ref}$. $T_{ref}$ may be, for example, a pre-set desired temperature for zone $Z_2$ chosen by a user. Additionally or in the alternative, a third reference climate control condition may be satisfied when zone $Z_3$ is above 50% humidity.

The example of FIG. 3 is illustrative of certain features variously found in different embodiments of the invention, although the specific implementation of those features may vary. For example, the number and types of reference climate control conditions may vary from that illustrated in table 332. Also, although the illustrative case of FIG. 3 shows at least part of a climate condition being received by receiving means 312 and at least part of reference climate condition being retrieved from memory 330, other embodiments may receive at least part of a reference climate condition at a receiving means, while retrieved from a memory at least part of a climate condition potentially satisfying the received reference climate condition.

Based at least in part on whether a climate control condition satisfies one or more reference climate control conditions, processing means will determine a climate conditioning 322 to be provided to a zone. In embodiments of the invention, processing means 320 may store the determined climate condition 332 in memory such as memory 330. Alternatively or in addition, processing means 320 may further provide an indication 324 of the determined climate conditioning 322 to be provided. For example, indication 324 may include a signal to a climate control system control means such as control means 220.

In varying embodiments of the invention, certain aspects of the determining means 210 may be stateless. For example, determining means 210 may determine that a climate control condition satisfies a priority condition without being provided either the exact climate condition or the exact priority condition. Alternatively or in addition, determining means 210 may determine that a zone for which a climate conditioning is to be determined has some priority—e.g. that the zone has not been excluded from being assigned any priority level of the priority type—without knowing the exact priority level assigned. Alternatively or in addition, the determining means 210 may, in response to the satisfying of a priority condition, determine a change to make to one or more climate conditioning means without knowing the exact climate resources being provided thereby.

Figure 4:
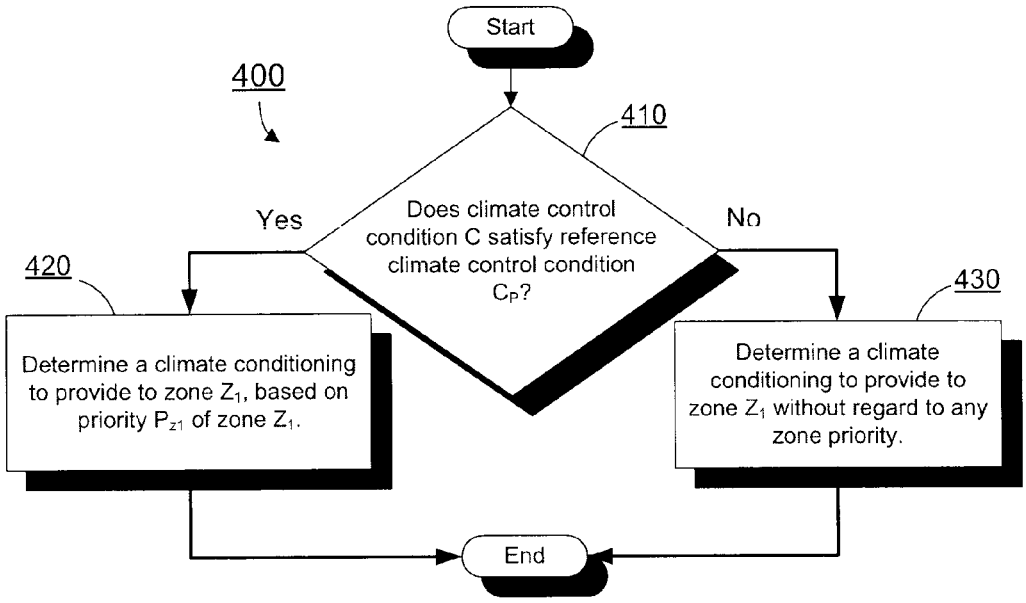
FIG. 4 is a flow diagram illustrating a method for determining, according to various embodiments of the invention, a climate conditioning to be provided to a zone.

FIG. 4 is a flow diagram illustrating a method 400 for determining, according to various embodiments of the invention, a climate conditioning to be provided to a zone $Z_1$. Various apparatus, systems and/or means described herein may implement various embodiments of the invention. Also, a machine readable medium may have stored thereon instructions which, when executed by one or more processors cause the one or more processors to perform a method according to one or various embodiments of the invention.

According to an embodiment of the invention implementing the method of FIG. 4, a determination may be made, at 410, as to whether a particular climate control condition C satisfies a reference climate control condition $C_P$. $C_P$ may, for example, be associated with a reference climate control condition, which is in turn associated with a priority $P_{z1}$ assigned to a zone $Z_1$. A reference climate control condition which is associated with priority of a zone may also be referred to as a priority condition. In embodiment of the invention, a priority indicates at least in part a relative preference between providing one or more climate conditioning resources to a zone assigned the priority and providing one or more climate conditioning resources to another zone. For example, assigning priority $P_{z1}$ to zone $Z_1$ may represent, at least in part, a ranking given to $Z_1$ with respect to one or more other zones in the determining of whether or how climate conditioning is to be provided to $Z_1$ and the one or more zones. $Z_1$ may have a priority $P_{a1}$ which is higher than a priority $P_{z2}$ of another zone $Z_2$, which may indicate that, at least in certain circumstances, $Z_1$ may be provided with one or more climate conditioning resources more readily than $Z_2$ may be provided with one or more climate conditioning resources. Similarly, $P_{z1}$ may be the same as or lower than $P_{z2}$, indicating, respectively, that one or more climate conditioning resources may be provided to $Z_1$ as readily as one or more climate conditioning resources may be provided to $Z_2$, or less readily than one or more climate conditioning resources may be provided to $Z_2$. A priority of a zone may be considered a climate control condition insofar as it describes a state associated with a climate control system.

Priorities may be assigned or reassigned to one or more zones by having a user explicitly enter priority values through any of a variety of inputs. Alternatively or in addition, priorities may be implicitly assigned or reassigned to one or more zones. For example, a zone may be implicitly assigned or reassigned a priority in response to an activity of a user, where the user is not aware that the activity has caused a priority assigning or reassigning to take place. In one embodiment of the invention, a priority may be increased at least temporarily in response to a user changing a desired climate condition setting of a zone.

If climate condition C satisfies $C_P$, at 420, a determining of a climate conditioning to provide to zone $Z_1$ is made based at least in part on $P_{z1}$ of zone $Z_1$. In various embodiment of the invention, a prioritized determining—i.e. a determining which takes into account a priority of a zone—for zone $Z_1$ may further be based on a climate control condition $C_{z2}$ of zone $Z_2$. For example, $C_{z2}$ may include a priority $P_{z2}$ assigned to $Z_2$. However, if climate condition C does not satisfy $C_P$, at 430, a determining of a climate conditioning to provide to zone $Z_1$ is made without regard to any priority of a zone. The determining of a climate conditioning to provide to $Z_1$ according to either of 420 and 430 may result in an end to a method implementing embodiments of the invention. In other embodiments of the invention, the determined climate conditioning to be provided to $Z_1$ may further be communicated or otherwise provided to one or more elements of a climate control system.

Figure 5:
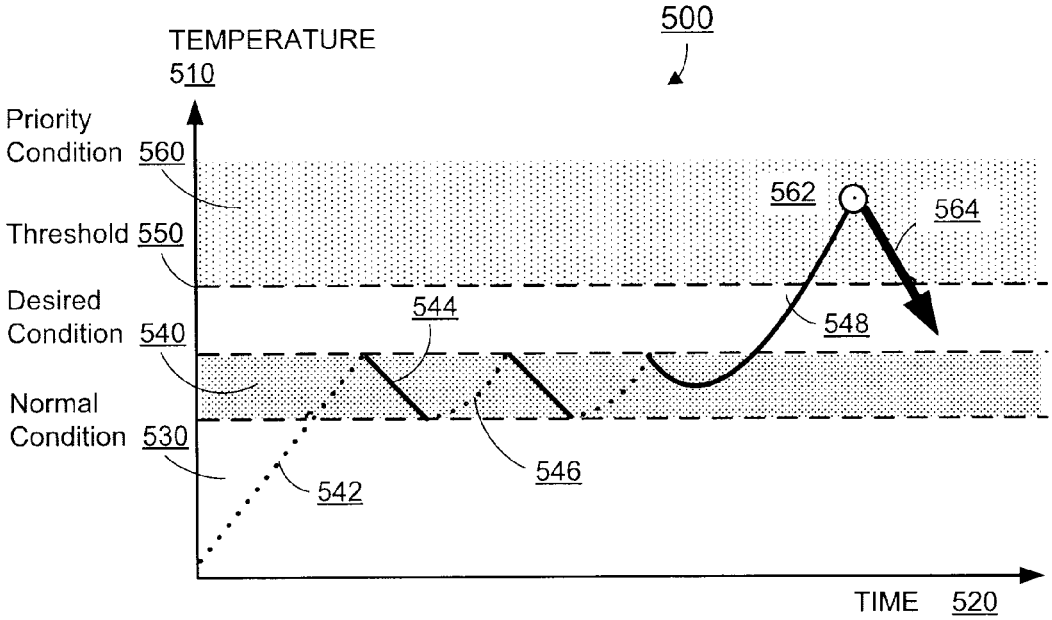
FIG. 5 is a graph illustrating a change in a climate of a zone over time, where a zone is provided with a climate conditioning according to an embodiment of the invention.

FIG. 5 is a graph 500 illustrating the change in a climate of a zone over time, where a climate conditioning determined according to an embodiment of the invention is provided to the zone. For the purposes of illustrating features of an embodiment of the invention, graph 500 demonstrates changes over time 520 to a single aspect of a climate of the zone—i.e. temperature 510. Also, graph 500 demonstrates a climate conditioning being provided based on a single aspect priority condition 560 associated with a priority of the zone. In this example, the priority condition 560 itself relates to the temperature 510 of the zone. More particularly, the priority condition 560 is satisfied when it is determined that the temperature 510 of the zone is above a threshold temperature 550. When the temperature 510 of the zone does not satisfy a priority condition 560, the climate conditioning may be determined without regard to any zone priority. This condition, e.g. where the range of temperature 510 of the zone is at or below threshold 550, may be described as a normal condition 530, wherein no condition of that zone satisfies a priority condition at least with respect to the type of priority in question. Determining a climate conditioning under normal condition 530 may include trying to keep temperature 510 at or near a desired condition 540 within normal condition 530. For example, a climate control system such as an air conditioning system may operate to keep the temperature 510 within a temperature range of the desired condition 540.

If the temperature 510 were to begin to rise, at 542, out of a desired condition 540, a non-prioritized determining of a climate conditioning—i.e. a determining without regard to a priority of a zone—may determine the providing of air conditioning, at 544, to stop the temperature 510 from increasing above the desired condition 540. When the temperature 510 is at or near a lower bound of the desired condition, the air conditioning may be decreased or stopped, at 546, to save climate conditioning resources.

Under certain operating conditions, the climate control system performance demonstrated in FIG. 5 may be unable to keep up with the load needed to keep the temperature 510 within the desired range or even within the normal range. For example, at 548, the temperature 510 of the zone may continue to increase until it is above threshold temperature 550. At some point 562, the climate control system will detect that the temperature 510 satisfies priority condition 560, whereupon a prioritized determining of a climate conditioning to provide to the zone is to be made, wherein the determining is based at least in part on a priority assigned to the zone.

In one embodiment, climate conditioning resources to be provided to the zone are thereby increased. This increase may result from a redistribution of climate conditioning resources, as when at least some climate conditioning resources previously provided to a zone having a lower priority or no priority are diverted or decreased at least temporarily. Alternatively or in addition, the increase may result from a net increase in the overall output of the climate control system, the net increase to provide at least in part for an increased level of climate conditioning of the zone. In response to the providing of the climate conditioning determined by the prioritized determining, the temperature 510 of the zone may decrease at 564.

In various embodiments of the invention, a prioritized determining of a climate condition may include determining a direction of climate conditioning resources away from the zone previously in a priority condition. For example, subsequent to providing to a particular zone a climate conditioning determined according to a prioritized determination, the climate condition of the particular zone which had satisfied the priority condition associated with the prioritized determination may change. As the climate condition of the particular zone changes—e.g. as the climate condition more closely or actually satisfies a normal condition associated with the priority type in question—one or more climate resources may be directed away from the particular zone to other zones such as the contributing zones from which climate resources were previously redirected. This changing of a climate conditioning previously determined according to a prioritized determining may also be based at least in part on one or more priorities assigned to a zone such as a contributing zone.

Figure 6:
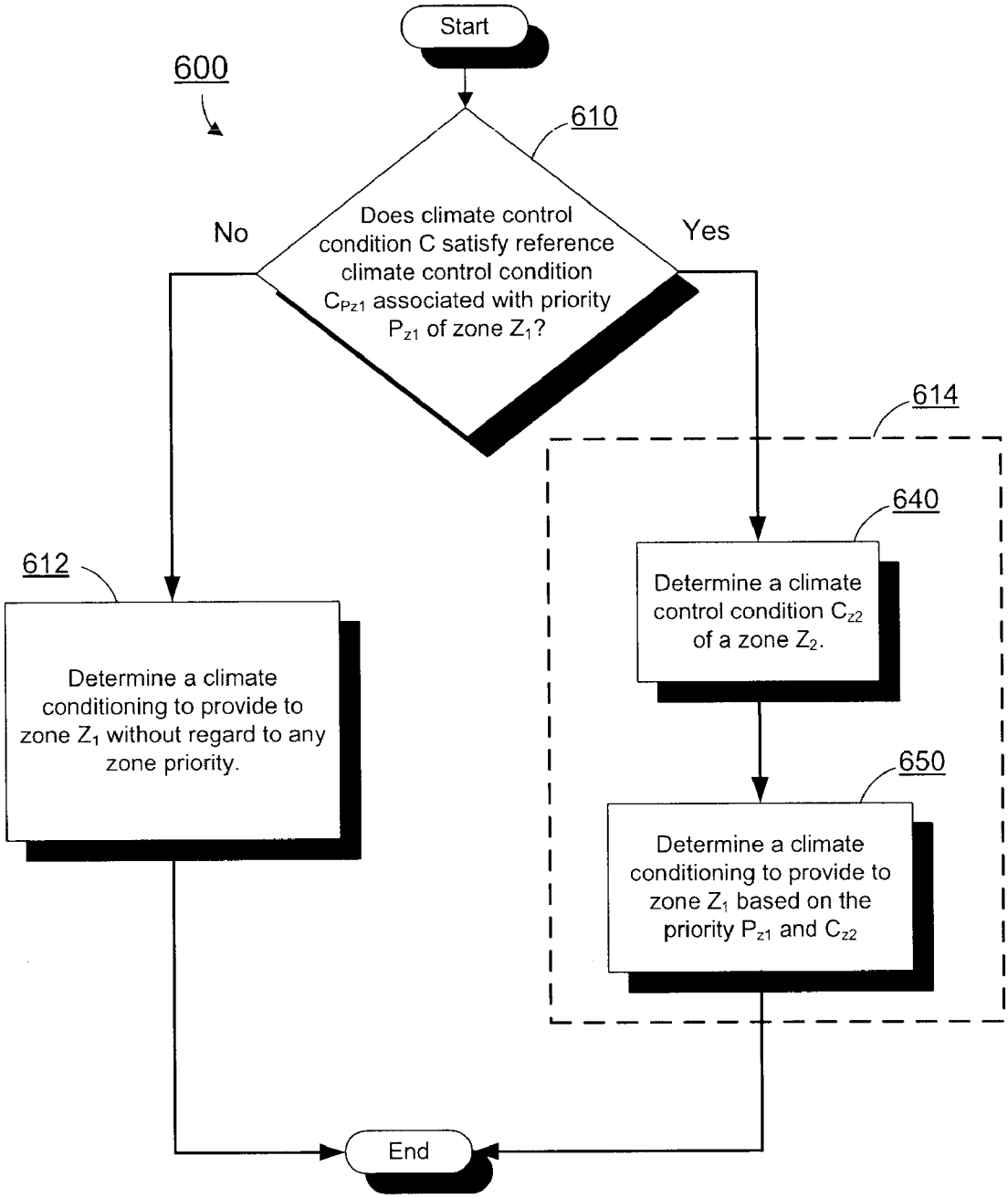
FIG. 6 is a flow diagram illustrating a method to determine a climate conditioning to provide to a zone.

FIG. 6 is a flow diagram illustrating a method 600 for determining a climate conditioning to provide to a zone according to embodiments of the invention. At 610, a determination may be made whether climate control condition C satisfies priority condition $C_{Pz1}$ associated with priority $P_{z1}$ of zone $Z_1$. If C does not satisfy $C_{Pz1}$, a non-prioritized determining 612 of a climate conditioning to provide to zone $Z_1$ may be implemented, wherein the determining may be made without regard to a priority of a zone. In the exemplary case of FIG. 6, the non-prioritized determining 612 may include determining if climate condition $Z_1$ is in a desired range. The desired range may, for example, be within a normal condition such as the normal condition 530 of FIG. 5. If the condition C is in the desired range, no new climate condition may need to be determined. For example, a climate control system at this point may determine to continue to provide a previously-determined climate conditioning. However, if the condition C is not in the desired range, then a climate conditioning needed to bring $Z_1$ into the desired range may be determined without regard to a priority of a zone.

However, if C does satisfy $C_{Pz1}$, a prioritized determining 614 of a climate conditioning to provide to zone $Z_1$ may be implemented, wherein the determining may be made based at least in part on priority $P_{z1}$ of zone $Z_1$. In one embodiment of the invention, the prioritized determining 614 of a climate conditioning to be provided to the zone may include determining a climate control condition $C_{z2}$ of a zone $Z_2$, at 640, and determining a climate control condition to provide to zone $Z_1$ based on the priority $P_{z1}$ and $C_{z2}$, at 650. In embodiments of the invention, the method may end once a climate conditioning is determined by one of a non-prioritized determining such as non-prioritized determining 612 and a prioritized determining such as prioritized determining 614. In other embodiments, the determined climate conditioning may be communicated to a climate control means. The climate control may further direct the operation of one or more climate control mechanisms to provide the climate conditioning to zone $Z_1$.

FIGS. 7A-7C illustrate a zone priority framework and an assigning of priority to a zone according to that zone priority framework. Information similar to that represented by FIGS. 7A-7C may be accessed or modified by a climate control system to implement prioritized climate conditioning to multiple zones according to embodiments of the invention. The particular implementation of how such information may be stored, compiled, accessed or modified may vary with different embodiments of the invention.

FIG. 7A is a table representing a priority set 700 of priority types 702. The priority set 702 may be available to a climate control system to provide priorities determining of climate conditioning to provide to a zone. The climate conditioning to be determined may include conditioning according to a combination of one or more climate conditioning resources 704. In the illustrative case of FIG. 7A, each priority type 1-5 may be associated with a particular combination of climate conditioning resources 704 of the climate control system. For example, six climate conditioning resources A-F are illustrated: a dehumidifier, a furnace, a refrigeration unit, an $O_2$ supply, an inert gas supply, and an air filter, respectively. The climate conditioning which is determined based on a particular priority type may include providing one or more climate conditioning resources associated with the particular priority type. By way of illustration, priority type 4 may be used to determine climate conditioning according to a combination of the $O_2$ supply, the inert gas supply, and the air filter. The determining of climate conditioning from a particular climate conditioning resource may be based on more than one priority type. By way of illustration, priority types 2 and 5 of the priority types 702 may each affect the determining of climate conditioning from climate conditioning resource B, a furnace. Furthermore, a given priority type 702 may have associated with it multiple priority levels 706. For example, priority types 1-5 have, respectively, two, ten, three, six and eight priority levels to which a given zone may be associated. Note that the lack of an assigning of a particular priority level of a particular priority type to a zone may functionally operate as an assignment to the zone of a default priority level for the particular priority type.

FIG. 7B is a table representing the priority conditions 710 associated with a priority set 702. For the purposes of illustrating the invention, priority conditions 710 continue from the example of the priority set 702 of FIG. 7A. For the illustrative case of FIG. 7B, each priority type 1-5 may be associated with a particular priority condition—a reference climate control condition which when satisfied indicates at least in part that a prioritized determining of a climate control condition is to be made. In an embodiment of the invention, when a climate control condition associated with a particular zone satisfies a particular priority condition of a particular priority type, a prioritized determining of a climate conditioning to be provided to the particular zone is made with regard to the priority level of the particular priority type which is assigned to the zone.

Each priority type 1-5 of priority types 702 has an associated priority condition indicated by data in priority condition information 714. In the case of priority type 1, a determining of a dehumidifying to be provided from climate conditioning resource A to a zone may be a prioritized determining, where total humidifier load for the climate control system is above 50%. Alternatively or in addition, for priority type 2, a determining of heat to be provided from climate conditioning resource B to a zone may be a prioritized determining where a temperature $T_N$ associated with the zone is below 45° F. Alternatively or in addition, for priority type 3, a determining of a refrigeration to be provided from climate conditioning resource C to a zone may be a prioritized determining where both a temperature $T_N$ associated with the zone is 5° F. above some reference temperature $T_{ref}$ and a humidity associated with the zone is above 80%. Alternatively or in addition, for priority type 4, a determining of a various climate conditioning to be provided from climate conditioning resources D, E and F to a zone may be a prioritized determining where an $O_2$ content associated with the zone is below 18%. Alternatively or in addition, for priority type 5, a determining of heat to be provided from climate conditioning resources B to a zone may be a prioritized determining where a temperature $T_N$ associated with the zone is between 45° F. and 55° F.

FIG. 7C is a table 720 illustrating a combination of various priorities associated with a Zone 1 according to an embodiment of the invention. For the purposes of illustrating the invention, the discussion of the associated priorities of Zone 1 continues from that of the exemplary priorities in FIGS. 7A and 7B. Each priority association may include an association with a priority type 702 and a priority level 724 of that priority type 702. For example, Zone 1 is shown having been assigned priorities types 2, 3 and 5 at levels 2, 1 and 4 of the respective priority types.

A zone such as Zone 1 may be associated with multiple priority types which correspond to one or more common climate conditioning resources. For example, Zone 1 may be associated with a priority level in each of priority types 2 and 5, where each priority type 2 and 5 indicates a respective prioritized determining of a heat to be provided from climate conditioning resource B. In the case where prioritized determining is based on the priority condition information represented by FIG. 7B, climate conditioning to be provided to Zone 1 may be determined based on a type 5, level 4 priority where a temperature associated with Zone 1 is between 45° F. and 55° F., and based on a type 2, level 2 priority where the temperature where the temperature associated with Zone 1 is below 45° F.

Furthermore, a priority condition of a particular priority type may include reference condition parameters 726 which are absolute values and/or condition parameters which are relative to some other reference value. For example, the priority condition of priority type 3, discussed with reference to FIG. 7B, includes a parameter $T_N$ having a particular value to be determined with respect to a reference value $T_{ref}$. An embodiment of the invention may provide for a reference value such as $T_{ref}$ being selectively determined for an individual zone or group of zones. For example, $T_{ref}$ may be set for Zone 1 to correspond to a desired temperature $T_{des}$. As $T_{des}$ is variously set or reset by a user, the parameter $T_N$ adjusts accordingly, thereby dynamically adjusting the priority condition for the priority type.

FIGS. 8A and 8B illustrate at least in part information which may be accessed in the course of a prioritized determining of a climate conditioning, according to various embodiments of the invention. A prioritized determining may include accessing information describing a response to a climate condition satisfying of a priority condition. Information similar to that represented by FIGS. 8A and 8B may be accessed or modified by a climate control system to determine climate control responses to a satisfied priority condition. The particular implementation of how such information may be stored, compiled, accessed or modified may vary with different embodiments of the invention.

FIG. 8A is a table 800 including response information for various priority levels to characterize at least in part the prioritized determining of a climate conditioning according to an embodiment of the invention. For the purposes of illustrating features of the invention, the discussion of response information 804 for priority levels 802 of a priority type follow from the discussion of a priority type 3 in FIGS. 7A-C. When a priority condition of priority type 3 is determined to be satisfied, the prioritized determining of a climate conditioning to be provided to a zone may include determining based at least in part on response information associated with the priority level of priority type 3 to which the zone in question is associated.

In various embodiments of the invention, a prioritized determining may include determining an amount of increased climate conditioning which needs to be provided to one or more zones and/or a source from which the increased climate conditioning is to be provided. For example, a level of refrigeration to the zone in question may be increased by 10% where the zone in question is associated with priority level 1 of priority type 3. Alternatively, a level of refrigeration to the zone in question may be increased by 20% where the zone in question is associated with priority level 2 of priority type 3. Alternatively, a level of refrigeration to the zone in question may be increased by 30% where the zone in question is associated with priority level 3 of priority type 3. The response information further provides that for each of the priority levels 802, the respective increased refrigeration to the zone in question is to be offset by an equal percent decrease in refrigeration to all of the other zones.

FIG. 8B is a block diagram illustrating response information 820 for various priority types and priority levels according to one embodiment of the invention. FIG. 8B represents response information characterizing at least in part a prioritized determining of a climate conditioning which is more granular than that shown in FIG. 8A. Response information 820 may include multiple sets of information 830, 840, 850, each of which represents response information for a particular priority level of a particular priority type.

For example, set of information 830 may describe at least in part a prioritized determining of a climate conditioning to be provided to a particular zone when a climate control condition is determined to satisfy a priority condition of priority type A. In this example, when a climate control system determines that a climate condition satisfies the priority condition of priority type A, a prioritized determining of a climate conditioning to be provided to a particular zone may be made based at least in part on the set of information 830. The prioritized determining of the climate conditioning to provide to the particular zone may include identifying a set of one or more other zones to contribute climate conditioning resources—i.e. zones from which one or more climate conditioning resources are to be selectively redirected. By way of illustration, where a priority condition associated with a particular priority type is satisfied, a zone which has assigned to it a priority level of that particular priority type may, at least by default, have climate conditioning resources redirected to it from all zones assigned a lower priority of the same priority type. In the example of FIG. 8B, identifier information 832 may further be provided to a processing means in aid of identifying at least some contributing zones and/or further limiting or expanding on a set of contributing zones identified by default. Contributing zones may be identified directly by a zone identifier, as with the particular reference to a "Zone 2" in identifier information 832. Alternatively or in addition, zones may be identified indirectly based on a more general description classifying the zone by type, as with the reference to zone group "Bedrooms" in identifier information 832. In various embodiments, identifier information 832 may further distinguish the one or more other contributing zones based on various climate control conditions associated with identified zones. For example, a zone which is otherwise identified in identifier information 832 is nevertheless excluded as a contributing zone, where a climate condition of identified zone satisfies a normal condition, but not a priority condition.

The prioritized determining of the climate conditioning to provide to the particular zone may further include determining a distribution of climate conditioning resources between the particular zone and the identified one or more other contributing zones. Distribution information 834 may be provided to a processing means in aid of the determining of a distribution of climate conditioning resources. The contributing zones identified by identifier information 832 in the set of information 830 may contribute to the determined climate conditioning based on distribution information 834 in the set of information 830. In various embodiments of the invention, additional contributing zones may be otherwise identified independent of the set of information 830, where the additional contributing zones are to contribute to the determined climate conditioning based on different distribution information. For example, the set of information 840 may also provide response information for priority level 1 of priority type A, while identifying a different set of contributing zones and different distribution information for that different set of contributing zones.

By way of illustration, the set of contributing zones identified by identifying information 832 may be given a weight of 20%, which may be used to determine how the contribution of the set of contributing zones is to compare with that of any additional contributing zones. For example, if no additional contributing zones are identified, then the set of contributing zones may offset all of the determined climate conditioning. If one or more additional sets of contributing zones are identified, then each of the sets may contribute a pro-rated offset to the determined climate conditioning, the pro-rating based on the relative weight of the respective set of contributing zones with respect to the weights of the other sets of contributing zones.

By way of illustration, additional parameters may be provided in distribution information 834 to describe a distribution of climate conditioning resources by contributing zones to the determined climate conditioning. For example, where the determined climate conditioning includes a providing of a rate of ventilation, the offset for the determined ventilation to be contributed by the set of contributing zones may be provided at increments of 50 cubic feet per minute (cfm). Alternatively or in addition, the set of contributing zones may reserve some minimum required amount of climate conditioning resources. For example, the set of contributing zones may reserve for themselves a minimum flow of 250 cfm.

Figure 9:
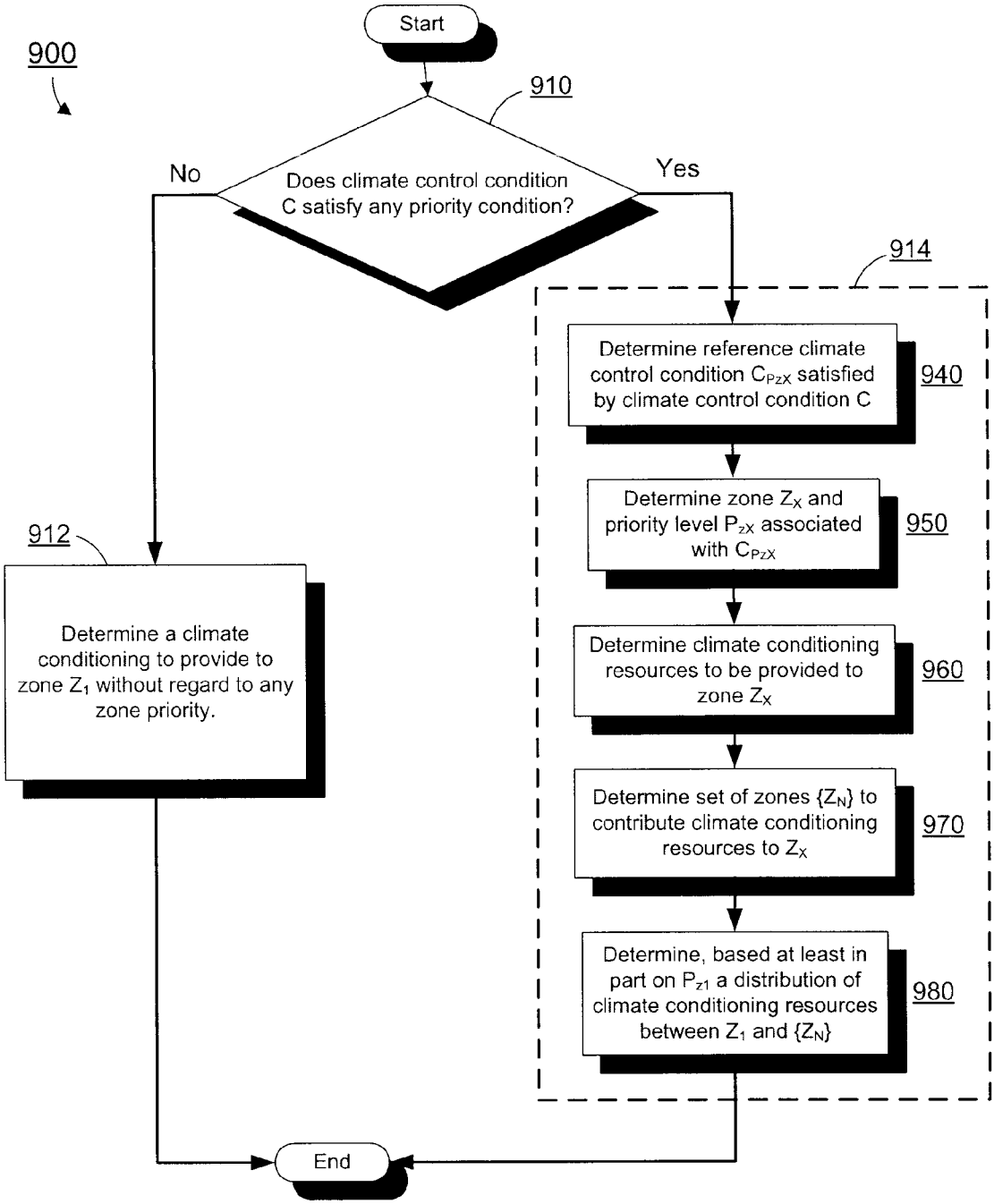
FIG. 9 is a flow diagram illustrating a method of determining, according to embodiments of the invention, a climate conditioning to be provided to a zone.

FIG. 9 is a flow diagram illustrating a method 900 to determine a climate conditioning to provide to a zone according to embodiments of the invention. At 910, at determination may be made whether climate control condition C satisfies any priority condition. If C does not satisfy any priority condition, a non-prioritized determining 912 of a climate conditioning to provide to zone $Z_1$ may be implemented, wherein the determining may be made without regard to a priority of a zone. In the exemplary case of FIG. 9, the non-prioritized determining 912 may include, determining if zone $Z_1$ is in a desired range. The desired range may, for example, be within a normal condition such as the normal condition 530 of FIG. 5. If the zone $Z_1$ is in the desired range, no new climate condition may need to be determined. For example, a climate control system may determine to continue to provide a previously-determined climate conditioning. However, if the zone $Z_1$ is not in the desired range, then a climate conditioning needed to bring $Z_1$ into the desired range may be determined without regard to a priority of a zone.

However, if climate control condition C does not satisfy a priority condition, a prioritized determining 914 of a climate conditioning to provide to zone $Z_1$ may be implemented, wherein the determining may be made based at least in part on priority $P_{z1}$ of zone $Z_1$. For example, a prioritized determining may include, at 940, determining a reference climate condition $C_{PzX}$ satisfied by climate control condition C. A determination may further be made, at 950, of a zone $Z_X$ and a priority level $P_{zX}$ associated with $C_{PzX}$, for example with reference to information such as that illustrated in FIG. 7C. In one embodiment, determining priority level $P_{zX}$ may include determining a priority type for the priority level $P_{zX}$. A determination may be made, at 960, of climate conditioning resources to be provided to zone $Z_X$, for example with reference to information such as response information 804. A determination may be made, at 970, of a set of zones $\{Z_N\}$ to contribute climate conditioning resources to zone $Z_X$, for example with reference to information such as identifier information 832. Furthermore, a determination may be made, at 980, of a distribution of climate conditioning resources between zone $Z_1$ and zones in the set of zones $\{Z_N\}$. This determined distribution of climate conditioning resources may include a determined climate conditioning to provide to zone $Z_1$. In embodiments of the invention, the method may end once a climate conditioning is determined by one of a non-prioritized determining such as non-prioritized determining 912 and a prioritized determining such as prioritized determining 914. In other embodiments, the determined climate conditioning may be communicated to a climate control means. The climate control may further direct the operation of one or more climate control mechanisms to provide the climate conditioning to zone $Z_1$.

Techniques and architectures for performing a prioritized determining of a climate conditioning are described herein. In the above description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed descriptions which follow are presented in terms of algorithms and symbolic representations of operations on data bits within a computer memory. These algorithmic descriptions and representations are the means used by those skilled in the computing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs) such as dynamic RAM (DRAM), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

Besides what is described herein, various modifications may be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. A method for selectively controlling a climate of a first zone of a building having multiple zones, the method comprising:

testing whether a climate control condition satisfies a first priority condition associated with the first zone, the first priority condition associated with a first priority assigned to the first zone, the first priority indicating at least in part a relative preference between providing one or more climate conditioning resources to a zone assigned the first priority and providing one or more climate conditioning resources to another zone;

if the testing indicates that the climate control condition satisfies the first priority condition associated with the first zone, then determining, based at least in part on the first priority assigned to the first zone, a climate conditioning to provide to the first zone, else if the testing indicates that the climate control condition does not satisfy the first priority condition associated with the first zone, then determining, without regard to the first priority assigned to the first zone, the climate conditioning to provide to the first zone; and sending to a control circuit a signal indicating the determined climate conditioning to provide to the first zone.

2. The method of claim 1, wherein the first priority of the first zone includes:

a first priority type associated with a set of one or more climate conditioning resources; and a first priority level of the first priority type.

3. The method of claim 1, further comprising:

providing to one or more zones a climate conditioning including the determined climate conditioning; and changing the provided climate conditioning based at least in part on a priority assigned to the one or more zones.

4. The method of claim 1, wherein the first priority condition associated with the first zone includes a climate condition of the first zone.

5. The method of claim 1, wherein the climate conditioning determining based at least in part on the first priority assigned to the first zone is further determined based on a climate control condition of a second zone of the multiple zones.

6. The method of claim 1, wherein determining, based at least in part on the first priority assigned to the first zone, the climate conditioning to provide to the first zone includes identifying one or more contributing zones from which a set of climate conditioning resources are to be redirected.

7. A machine readable storage medium having stored thereon instructions which, when executed by one or more processors cause the one or more processors to perform a method comprising:

testing whether a climate control condition satisfies a first priority condition associated with the first zone, the first priority condition associated with a first priority assigned to the first zone, the first priority indicating at least in part a relative preference between providing one or more climate conditioning resources to a zone assigned the first priority and providing one or more climate conditioning resources to another zone;

if the testing indicates that the climate control condition satisfies the first priority condition associated with the first zone, then determining, based at least in part on the first priority assigned to the first zone, a climate conditioning to provide to the first zone, else if the testing indicates that the climate control condition does not satisfy the first priority condition associated with the first zone, then determining, without regard to the first priority assigned to the first zone, the climate conditioning to provide to the first zone; and sending to a control circuit a signal indicating the determined climate conditioning to provide to the first zone.

8. The machine readable storage medium of claim 7, wherein the first priority of the first zone includes:

a first priority type associated with a set of one or more climate conditioning resources; and a first priority level of the first priority type.

9. The machine readable storage medium of claim 7, the method further comprising:

providing to one or more zones a climate conditioning including the determined climate conditioning; and changing the provided climate conditioning based at least in part on a priority assigned to the one or more zones.

10. The machine readable storage medium of claim 7, wherein the climate control condition satisfying the first priority condition associated with the first zone includes a climate condition of the first zone.

11. The machine readable storage medium of claim 7, wherein the climate conditioning determining based at least in part on the first priority assigned to the first zone is further determined based on a climate control condition of a second zone of the multiple zones.

12. The machine readable storage medium of claim 7, wherein determining, based at least in part on the first priority assigned to the first zone, the climate conditioning to provide to the first zone includes identifying one or more contributing zones from which a set of climate conditioning resources are to be redirected to the first zone.

13. A system to selectively control a climate of a first zone of a building having multiple zones, the system comprising:

receiving means for receiving one of a climate control condition and a first priority condition associated with the first zone, the first priority condition associated with a first priority assigned to the first zone, the first priority indicating at least in part a relative preference between providing one or more climate conditioning resources to a zone assigned the first priority and providing one or more climate conditioning resources to another zone;

a memory to store the other of the climate control condition and the first priority condition associated with the first zone;

processing means coupled to the receiving means and the memory, the processing means for testing whether the climate control condition satisfies the first priority condition associated with the first zone, wherein if the testing indicates that the climate control condition satisfies the first priority condition associated with the first zone, then the processing means further for determining, based at least in part on the first priority assigned to the first zone, a climate conditioning to provide to the first zone, else if the testing indicates that the climate control condition does not satisfy the first priority condition associated with the first zone, then the processing means further for determining, without regard to the first priority assigned to the first zone, the climate conditioning to provide to the first zone.

14. The system of claim 13, wherein the first priority of the first zone includes:

a first priority type associated with a set of one or more climate conditioning resources; and a first priority level of the first priority type.

15. The system of claim 13, wherein determining, based at least in part on the first priority assigned to the first zone, the climate conditioning to provide to the first zone includes identifying one or more contributing zones from which a set of climate conditioning resources are to be redirected.

16. The system of claim 15, wherein determining, based at least in part on the first priority assigned to the first zone, a climate conditioning to provide to the first zone further comprises determining a distribution of climate conditioning resources between the first zone and the one or more contributing zones.

17. The system of claim 13, the system further comprising:

control means coupled to the determining means to provide climate conditioning control signals based at least in part on the determined climate conditioning;

climate conditioning means coupled to the control means to provide a climate conditioning to one or more zones including the first zone in response to the climate conditioning control signals of the control means the processing means further to determine a change to the provided climate conditioning based at least in part on a priority assigned to the one or more zones.

18. The system of claim 13, wherein determining the climate conditioning to provide to the first zone includes pro-rating a distribution of one or more climate conditioning resources among one or more zones, the pro-rating based at least in part on respective weights assigned to the one or more zones.

19. The system of claim 13, wherein determining that a climate control condition of the first zone satisfies a first priority condition associated with the first zone comprises:

determining the first priority condition associated with the first zone;

receiving an indication of the climate control condition of the first zone; and comparing the received indication of the climate control condition of the first zone to the determined first priority condition associated with the first zone.

20. An apparatus comprising:

a receiver to receive one of a climate control condition and a first priority condition associated with the first zone, the first priority condition associated with a first priority assigned to the first zone, the first priority indicating at least in part a relative preference between providing one or more climate conditioning resources to a zone assigned the first priority and providing one or more climate conditioning resources to another zone;

a memory to store the other of the climate control condition and the first priority condition associated with the first zone;

one or more processors coupled to the receiver and the memory, the one or more processors to test whether the climate control condition satisfies the first priority condition associated with the first zone, wherein if the testing indicates that the climate control condition satisfies the first priority condition associated with the first zone, then the one or more processors further to determine, based at least in part on the first priority assigned to the first zone, a climate conditioning to provide to the first zone, else if the testing indicates that the climate control condition does not satisfy the first priority condition associated with the first zone, then the one or more processors further to determine, without regard to the first priority assigned to the first zone, the climate conditioning to provide to the first zone.

21. The apparatus of claim 20, wherein determining, based at least in part on the first priority assigned to the first zone, the climate conditioning to provide to the first zone includes identifying one or more contributing zones from which a set of climate conditioning resources are to be redirected.

22. The apparatus of claim 20, further comprising assigning the first priority to the first zone.

23. The apparatus of claim 22, wherein assigning the first priority comprises assigning in response to an implicit request of a user.

* * * * *